US006464106B1

(12) United States Patent
Giblin et al.

(10) Patent No.: US 6,464,106 B1
(45) **Date of Patent: *Oct. 15, 2002**

(54) STRESS CRACK RESISTANT BOTTLE

(75) Inventors: Edward John Giblin, Finksburgh; Arnold Brown, Owings Mills; Suzanne Benigni, Finksburg, all of MD (US); Jeannine Desmond Griffiths, Sao Paulo (BR); Gregory Alan Lathrop, Manchester, MD (US)

(73) Assignee: Lever Brothers Company, Division of Conopco, Inc., New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 178 days.

(21) Appl. No.: 08/775,209

(22) Filed: Dec. 31, 1996

(51) Int. Cl.[7] ..... B67D 1/16

(52) U.S. Cl. ..... 222/109; 215/12.1; 215/371; 215/382

(58) Field of Search ..... 215/382, 371, 215/12.1; 222/109

(56) References Cited

U.S. PATENT DOCUMENTS

| | | | | | |
|---|---|---|---|---|---|
| 3,029,963 | A | | 4/1962 | Evers | |
| D192,888 | S | | 5/1962 | Kaplan | |
| D195,697 | S | | 7/1963 | Price | |
| 3,385,461 | A | | 5/1968 | Mallin | |
| D265,797 | S | | 8/1982 | Platte | |
| 4,359,165 | A | | 11/1982 | Jakobsen | |
| D272,318 | S | | 1/1984 | Visser | |
| 4,550,862 | A | | 11/1985 | Barker et al. | |
| 4,567,069 | A | * | 1/1986 | Jabarin | 428/35 |
| 4,577,768 | A | | 3/1986 | Go et al. | |
| D286,379 | S | | 10/1986 | Lyons | |
| 4,620,639 | A | | 11/1986 | Yoshino | |
| 4,668,834 | A | | 5/1987 | Rim et al. | |
| 4,747,992 | A | | 5/1988 | Sypula et al. | |
| 4,785,948 | A | | 11/1988 | Strassheimer | |
| D300,005 | S | | 2/1989 | Jacobs et al. | |
| 4,846,359 | A | | 7/1989 | Baird et al. | |
| 4,874,734 | A | | 10/1989 | Kioka et al. | |
| D305,407 | S | | 1/1990 | Gonda | |
| 4,890,757 | A | * | 1/1990 | Robbins, III | 220/72 |
| D306,140 | S | | 2/1990 | Chambers et al. | |
| 4,949,851 | A | | 8/1990 | Cochran | |
| D311,864 | S | | 11/1990 | Davis | |
| D312,964 | S | | 12/1990 | Carmine et al. | |
| 5,021,109 | A | | 6/1991 | Petropoulos et al. | |
| D321,524 | S | | 11/1991 | Fiore et al. | |
| 5,080,244 | A | | 1/1992 | Yoshino | |
| 5,108,009 | A | * | 4/1992 | Davidson et al. | 222/109 |

(List continued on next page.)

FOREIGN PATENT DOCUMENTS

| | | |
|---|---|---|
| DE | 31 39 083 | 12/1982 |
| DE | 92 12 023 | 9/1992 |
| DE | 295 03 460 | 4/1995 |
| EP | 198 587 | 6/1986 |
| EP | 322 651 | 7/1989 |
| EP | 824 137 | 1/1993 |
| GB | 2 042 408 | 12/1979 |
| GB | 2 164 914 | 10/1984 |
| GB | 2033440 | 1/1994 |
| NL | 92 01 806 | 10/1992 |
| WO | 94/25350 | 11/1994 |

*Primary Examiner*—Kevin Shaver
*Assistant Examiner*—Stephanie Willatt
(74) *Attorney, Agent, or Firm*—Gerard J. McGowan, Jr.

(57) ABSTRACT

Improved bottles for dispensing liquid household products such as liquid detergents and fabric softeners. The package is comprised of a multilayer body in which the inner layer includes polyethylene made with a metallocene catalyst. The bottles have improved stress cracks resistance yet may be lighter then traditional bottles. They may be made by blow molding.

35 Claims, 5 Drawing Sheets

U.S. PATENT DOCUMENTS

D326,052 S 5/1992 Beechuk et al.
5,128,091 A 7/1992 Agur et al.
D332,747 S 1/1993 Darr et al.
5,206,075 A 4/1993 Hodgson, Jr.
5,224,623 A 7/1993 LaFleur
5,232,107 A 8/1993 Krall et al.
5,254,302 A * 10/1993 Yamanaka ..... 264/129
D348,612 S 7/1994 Ring
D351,347 S * 10/1994 Ring ..... D9/528
5,358,792 A 10/1994 Metha et al.
D353,541 S 12/1994 Rogler et al.
5,374,459 A 12/1994 Mumpower et al.
5,376,439 A 12/1994 Hodgson et al.
5,382,631 A * 1/1995 Stehling et al. ..... 525/240
5,393,599 A 2/1995 Quantrille et al.
5,397,613 A 3/1995 Georgelos et al.
5,397,640 A 3/1995 Georgelos et al.
5,419,795 A 5/1995 Wood et al.
5,420,220 A 5/1995 Cheruvu et al.
5,422,172 A 6/1995 Wu
5,469,984 A 11/1995 Kalkanis
5,693,283 A * 12/1997 Fehn ..... 264/513

* cited by examiner

STRESS CRACK RESISTANT BOTTLE

BACKGROUND OF THE INVENTION

One popular form of laundry detergent is the heavy duty laundry liquid. Its popularity is due in part to the convenience of the product form, in particular the ability to apply the detergent readily to soiled areas of the clothes. The popularity of laundry liquids has created a need for more convenient containers for dispensing these products. Thus, bottles having measuring cups serving as closures, and fitments incorporating drainage mechanisms and pouring spouts have appeared on the market.

One type of container is exemplified by that of Barker U.S. Pat. No. 4,550,862 wherein a bottle includes a fitment having a spout and a structure permitting the product to drain back into the container. The fitment has internal threads at its upper aspects which mate with external threads surrounding the mouth of a bottle closure. The threads at the mouth of the closure mate with their counterparts at the upper aspects of the fitment, the cup does not extend very far into the fitment, and the drainback region of the fitment can be shallow.

Other containers have been developed using a different approach. The container disclosed in Davidson et al. U.S. Pat. No. 5,108,009 comprises a spout- and drainback-including fitment which snaps into the mouth of the bottle. The closure has internal threads situated within a flange which surrounds the measuring cup portion of the closure. The internal threads of the closure mate with external threads surrounding the neck opening.

While consumers appreciate the benefits of modem liquid detergent containers having measuring closures and drainback fitments, these sophisticated packages are not without their cost. Many of these containers include three separate parts, a body, a fitment and a closure. These components are typically made of plastic and each requires a certain amount of plastic to perform its structural function.

The amount of plastic material used in making liquid detergent containers, also should be considered from an environmental standpoint. It would be desirable to minimize the amount of such materials so that in those cases where the package is not recycled a smaller amount of plastic material reaches the landfill or other disposal area. Also it is desirable to develop a structure which can utilize a significant amount of recycled material.

Plysu of Great Britain sells and illustrates in a brochure ultra light weight bottles under the name Paklite. Its 5 liter bottle weights 90 grams (0.53 g per fluid oz.). The bottles have a handle, eight panels, include vertical grooves extending most of the height of the panel at eight corners and have waffles in the bottom. Plysu also holds British registered design 2033440 which illustrates their bottle.

Robbins U.S. Pat. No. 4,890,757 discloses an enclosure having self supporting side walls formed of a plurality of spaced ribs with non self supporting thin webs therebetween.

Chochran U.S. Pat. No. 4,949,801 discloses a thin wall blow molded plastic container including a body, a neck support member 20 and lateral support members 18.

NL 9201806 discloses a bottle having a handle, a reinforcing profiled bottom, and a reinforcing groove (14).

GB 2164914 is directed to a bottle provided with a handle and a bottom having waffle-like grooves.

German Gebrauchsmuster 9212023 is directed to a thin walled bottle having an octagonal shape, a handle and grooves.

DE 31 39 083 discloses a bottle having a handle and provided with various reinforcing grooves.

German Gebrauchsmuster 29503460 discloses a bottle having grooves running around the top, body and bottom of the bottle.

EP 624 137 is directed to a thin walled bottle having side walls textured to 0.05 to 0.15 mm. U.S. Pat. No. 5,522,519 appears to be an equivalent.

GB 2 042 408 discloses a bottle of saturated polyester resin having an opaque and matt surface.

EP 322 651 is directed to a bottle having reinforcing vertically extending ribs (76).

EP 198 587 is directed to a bottle having various reinforcing grooves.

Kalkanis U.S. Pat. No. 5,469,984 discloses a thermoplastic container having an anti-bulging base with a flat ring-shaped section and a central dome-shaped section.

It is known to adhere a bottle label to the bottle in the mold.

Jabarin U.S. Pat. No. 4,567,069 discloses blow molded polymeric containers said to have good physical properties and good resistance to environmental stress cracking. The walls and bottom of the container are fabricated from a multilayer polymeric material. A thin inner wall is fabricated from a linear low density ethylene polymer. The thicker outer wall is fabricated from a linear high density ethylene polymer. The material will generally contain two layers, but for special applications three or more may be used. The linear high density ethylene polymers will have a density of at least about 0.94 gm/ml, preferably at least 0.95 and more especially at least about 0.96 as containers prepared from such resins are said to have greater stiffness. It is said that somewhat thinner containers can be employed with no loss of stiffness.

Go et al. U.S. Pat. No. 4,577,768 is directed to polymer blends containing 75–90 wt. % linear high density ethylene polymer and 10–25 wt % of a linear low density ethylene polymer (density less than 0.93 g/ml). The blends are said to have a combination of physical properties and environmental stress crack resistance which make them well suited for conversion to blow molded containers for use in packaging aqueous detergent compositions.

Strassheimer U.S. Pat. No. 4,785,948 illustrates a container with a hexagonal section. The patent is directed to bottles with thickened portions extending completely circumferentially around the periphery.

Yoshino U.S. Pat. No. 5,080,244 discloses a synthetic resin thin walled bottle having ribs at least at its bottom portion.

Jakobsen U.S. Pat. No. 4,359,165 discloses a reinforced thermoplastic container having internal reinforcing ribs.

Yoshino U.S. Pat. No. 4,620,639 discloses synthetic resin, thin walled bottles having ribs at least at the bottom. Ribs extending the full axial length of the barrel portion, whereby buckling strength is said greatly to be increased, are disclosed in FIG. 6.

Evers U.S. Pat. No. 3,029,963 discloses a bottle with vertically extending ribs.

LaFleur U.S. Pat. No. 5,224,623 discloses a fast food container reinforced by ribs which wrap around the container side walls.

Mumpower et al. U.S. Pat. No. 5,374,459 discloses a thermoplastic laminate for long term storage of food products. It includes a core layer of EVA, two interior adhesive layers and two surface layers comprising a blend of linear ethylene alpha olefin copolymer and an ethylene unsaturated ester copolymer. Linear ethylene alpha olefin copolymer is defined to include metallocene catalyzed polymers such as those supplied by Exxon.

Exxon Chemical's brochure entitled "EXACT™ PLASTOMERS for Targeted Performance in Polyolefin Modification" provides information on the properties of its metallocene polyethylene plastomers.

Stehling et al. U.S. Pat. No. 5,382,631 is directed to interpolymer blends which may comprise linear polyethylenes prepared by catalyst systems of the metallocene type. It is said that the blends of the invention can be used to advantage in all forming operations, such as blow molding, injection molding and roto molding and that molded articles include single and multilayered constructions in the form of bottles, tanks, etc.

Hodgson et al. U.S. Pat. No. 5,376,439 discloses a polymer composition comprising a blend of a very low density ethylene polymer and a low to medium density ethylene polymer.

Metallocene catalysts may be used. The invention also provides for films prepared from the blend which may have a single layer construction or a laminated ABA construction wherein the A layer comprises the blend of the invention and the B or core layer comprises a different olefin layer such as high density polyethylene.

Metha et al. U.S. Pat. No. 5,358,792 is directed to heat sealable compositions comprising a) a low melting polymer comprising an ethylene based copolymer having a density of from 0.88 g/cm3 to about 0.915 g/cm3 and b) a propylene based polymer. The ethylene based copolymer is produced with a metallocene catalyst.

A Hodgson U.S. Pat. No. 5,206,075 is directed to a laminar polyolefin film material having a base film layer which is a blend of an olefin polymer and a very low density copolymer of ethylene. The VLDPEs which may be used as the copolymer component of the base or sealing layers of the film of the invention can be polymerized with the use of metallocene catalyst systems. The films are said to be very useful for high speed packaging operations.

Wu U.S. Pat. No. 5,422,172 discloses an elastic laminated sheet made of a nonwoven fibrous web and an elastomeric film. The elastomeric film may be made using metallocene catalysts.

Cheruvu et al. U.S. Pat. No. 5,420,220 discloses a film of a linear low density copolymer of ethylene (LLDPE) said to have excellent processability, optical properties and impact strength. The resins are said to exhibit narrower molecular weight distribution.

The following patents relate to metallocenes: Wood et al. U.S. Pat. Nos. 5,419,795, Georgelos et al. 5,397,640, Georgelos 5,397,613, Quantrille et al. 5,393,599, Agur et al. 5,128,091, Petropoulos et al. 5,021,109, Kioka et al. 4,874,734, Sypula et al. 4,747,992 and Rim et al. 4,668,834.

Other containers are illustrated in Rogler et al. U.S. Pat. Nos. Des. 353,541, Ring Des. 351,347, Ring Des. 348,612, Darr et al. Des. 332,747, Jacobs Des. 300,005, Visser Des. 272,318, Platte Des. 265,797, Kaplan Des. 192,886, Price Des 195,697, Lyons Des. 286,379, Gonda Des. 305,407, Chambers Des. 306,410, Davis Des. 311,864, Carmine Des. 312,964, Fiore et al. Des. 321,624, Beechuk et al. Des. 326,052, Baird et al. 4,846,359, Krall et al. 5,232,107, Mallin 3,385,461 and WO 94/25350.

SUMMARY OF THE INVENTION

The present invention is directed to improved bottles for dispensing liquid household products such as liquid detergents and liquid fabric softeners. The package is comprised of a multilayer body in which the inner layer includes polyethylene made with a metallocene catalyst. Metallocene catalysts are used to produce polymers having very low densities. The bottles of the invention enjoy improved stress crack resistance yet may be lighter than traditional bottles. Preferably the metallocene polyethylene layer is the inside layer of a trilayer structure.

The metallocene layer may comprise 100% of the bottle's inside layer. Or, the inside layer may be a blend comprising 10–99 wt % metallocene plastomer. Preferably the other blend component is high density polyethyene. The plastomer blends readily with HDPE.

The metallocene plastomer resin used in the bottle of the invention has a density of 0.910 or less, preferably 0.900 or less.

In further embodiments, the multilayer bottle body is combined with other features such as a downwardly extending body having from 6–10 axially extending side panels fabricated from the multiple polymer layers. The packages preferably are in the form of a bottle having a drainback fitment. Advantageously, the bottle is lightweight, thereby conserving valuable resources and minimizing waste, but at the same time is functional as a heavy duty liquid detergent or other dispenser. With use of the metallocene resins in accordance with the invention, the bottle may be significantly lightweighted without adversely affecting stress crack resistance (ESCR) or impact resistance properties.

Metallocene polymers are described in Stehling et al. U.S. Pat. Nos. 5,382,631 and Mehta et al. 5,358,792, the disclosures of which are incorporated by reference herein.

In preferred embodiments, the octagonal or other polygonal shape and multilayer resin structure, are combined with other features to form a lightweight bottle suitable for use as a heavy duty liquid detergent container. Preferably, the bottle is also suitable for other uses, such as containing liquid fabric softeners, light duty liquid detergents, eg hand dishwashing detergents), automatic dishwashing detergents such as gels, chemicals, foods, etc. Among these other, optional, features are grooves or ribs on at least 50% of the corners where the side panels intersect, an in-mold label, an increased finish diameter ranging from about 50 to about 88 mm, especially from 51 to 77 mm, and an off centered neck. The pour spout preferably has a bottom wall with a product drainage aperture. The grooves or ribs, if present, preferably extend axially at least 60% of the distance along the intersections of the panels. An optional tapered base panel extends from the side panels to the bottle base.

Pouring of product from the container is believed to be faciliated in the present combination of light weight and off-centered neck.

The lighter weight of the body of the bottle and the finish make the bottle less expensive and more sparing of valuable resources. Moreover, less plastic material needs to be recycled or disposed of in the landfill or otherwise. Bottles according to the invention preferably weigh approximately 20–50% less than bottles traditionally used to contain heavy duty liquids. Preferably the bottle of the invention (not include the closure or fitment) weighs less than 1.2 grams per fluid oz of capacity. Especially preferred is that the bottle weigh between 1 gram and 0.5 grams per fluid oz.

The bottles of the various embodiments of the invention may also include an optional handle or other integral gripping feature.

The multilayer bottle of the invention is advantageously fabricated with certain resins. In addition to the inner metallocene polyethylene, layer, a bottle having one or more of the following is preferred: an outer layer comprised of a high density resin and a layer, preferably a middle layer, employing at least 25% recycled resin.

For a more complete understanding of the above and other features and advantages of the invention, reference should be made to the following detailed description of preferred embodiments and to the accompanying drawings.

DETAILED DESCRIPTION OF THE INVENTION

Figure 1:
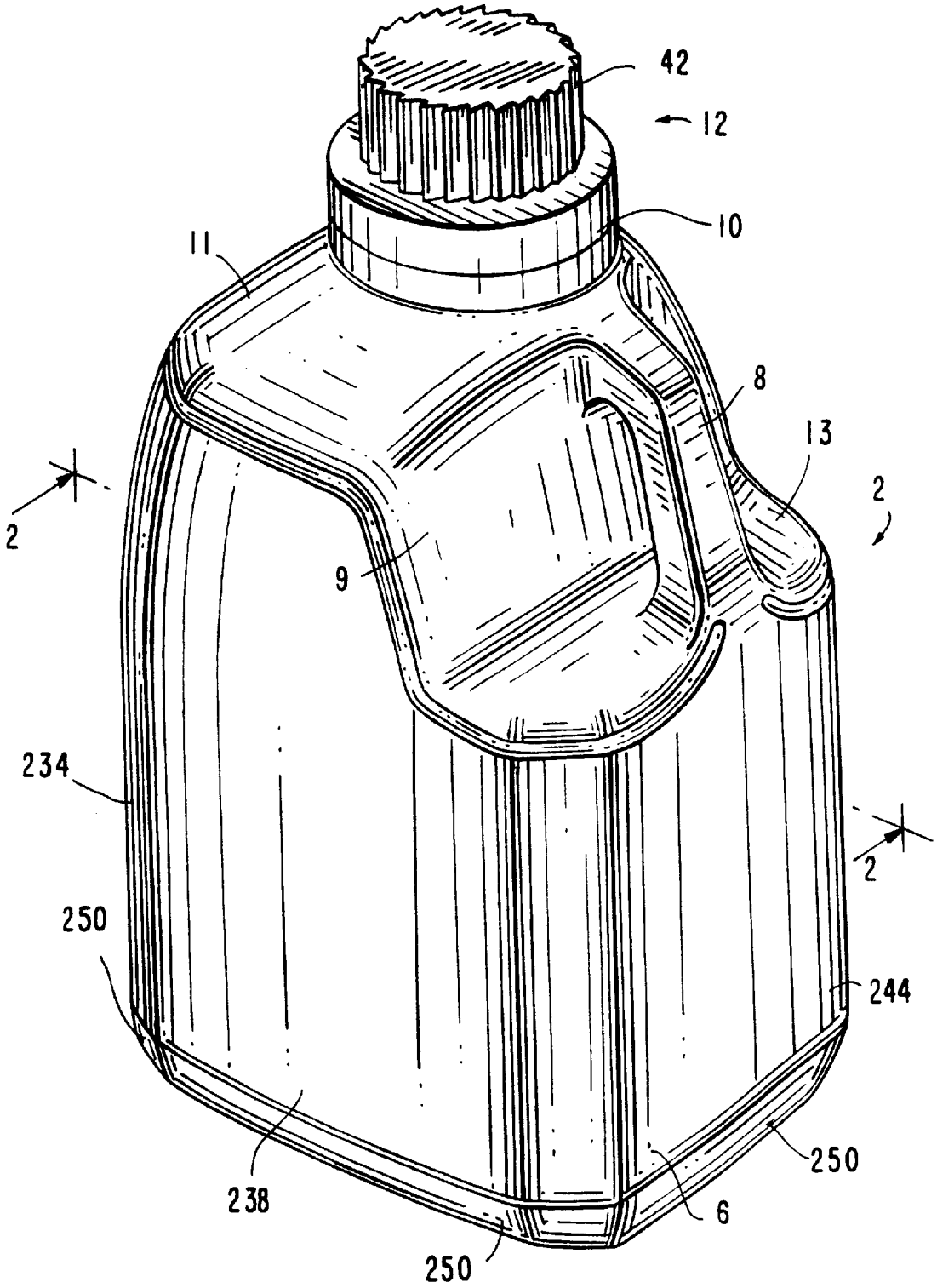
FIG. 1 is a perspective view of a container of the invention with the closure fastened.
Figure 2:
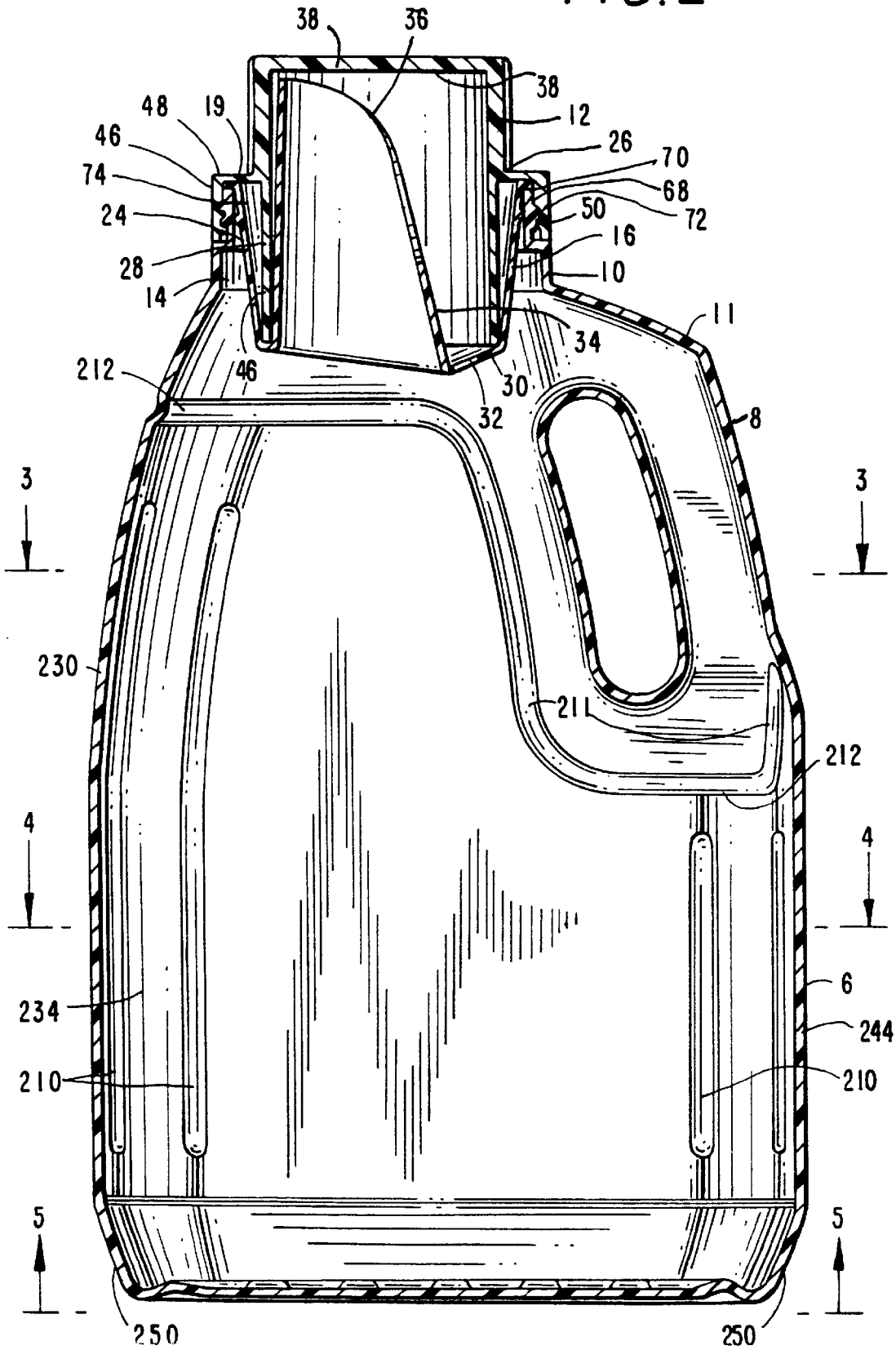
FIG. 2 is a section along the lines 2—2 of FIG. 1, except that the container additionally includes corner grooves.

Referring now particularly to the drawings, a bottle of the invention utilizing an inner metallocene polyethylene plastomer layer will be described with respect to a specific embodiment. In FIGS. 1 and 2 there is shown a container 2 including a bottle 6 having an integral handle 8 and a neck 10. The container 2 also includes a drainback fitment 14. Fastened to the top of the container 2, as viewed in FIG. 1, there is a closure or cap 12. All of the foregoing components are preferably molded from a resilient flexible plastic material. The materials may be selected so that the plastic from which the drainback fitment 14 is molded is softer than the materials from which the bottle 6 and closure 12 are formed. Alternatively, the drainback fitment may be made of a material of comparable hardness to that of which the closure is made, e.g., polypropylene or HDPE.

The drainback fitment has an outer, frustoconical wall portion 16 which gradually tapers downwardly and inwardly and is received within the neck 10 of the bottle 6. The wall portion 16 terminates at its upper end in an annular rim 19. Rim 19 is generally flat.

Figure 3:
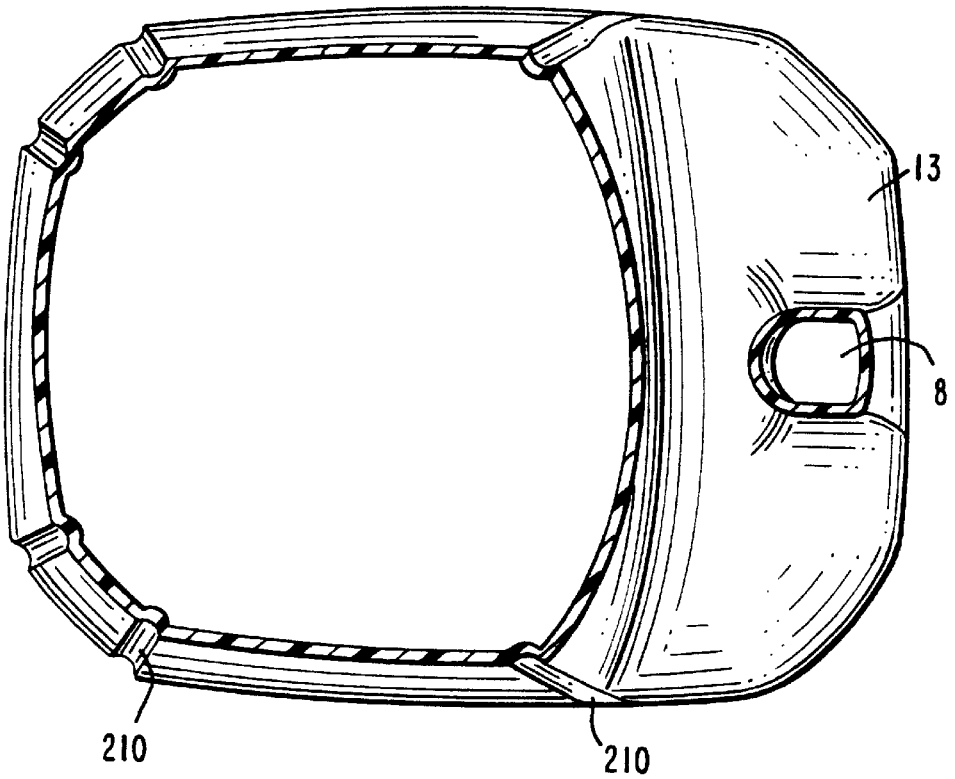
FIG. 3 is a section along the lines 3—3 of FIG. 2.

The surface of the rim turns downwardly and inwardly to form the outer wall 24 of a circumferential well 26 surrounding a generally frustoconical, eccentrically positioned (off-center) spout 36, the lower periphery of which forms the inner wall 28 of the circumferential well 26. Between the outer wall 24 and inner wall 28 of the circumferential well 26 there is a sloping floor 30. The outer surface of wall 16 optionally includes a retaining ring which is spaced from and generally concentric with rim 19. Wall 16 may include a product exit aperture (or drain port) located above and spaced from the product drainage aperture 32. The basic features of the fitment, bottle finish and closure are as shown in FIG. 9 of Davidson et al. U.S. Pat. No. 5,108,009, the disclosure of which patent is hereby incorporated by reference herein. An appropriate product drainage aperture is illustrated in more detail in FIG. 3 of Davidson et al.

The product drainage aperture or notch 32 preferably comprises a substantially rectangular notch formed in the lowest and widest portion of the floor 30 and is desirably in alignment with a longitudinal slot 34 which extends from the top of the rear of the spout. While the longitudinal slot may extend to the notch 32 and merge therewith (as shown in FIG. 2), of the invention, if desired, the slot may extend only approximately halfway down the length of the spout.

The spout may include projections to keep the fitments separated during stacking. Such projections may also serve to prevent rotation of the spouts during stacking when combined with lugs (not shown) depending from the bottom of the fitment and situated so that they block radial movement of the stacking projections on the next lower fitment when the fitments are stacked.

Notch 32 and longitudinal slot 34 provide a path for residual liquid remaining on the spout 36 or closure 12 to drain back into the bottle 6 either directly or via the downwardly sloping floor 30 of the circumferential well 26 under the force of gravity when the container 2 is in an upright position.

Fitment 14 is secured to bottle finish 68 by a friction fit. Bottle finish 68 includes an annular mouth 70, and a locking ridge 72. The finish includes threads 74. The fitment is inserted into the bottle by forcing it through the opening at the bottle mouth and pushing it until annular rim 19 of the fitment is situated upon or above locking ridge 72. If rim 19 is above locking ridge 72, preferably it is immediately above. In this position, the distal end of the annular rim will be adjacent to bottle mouth 70. Optionally, a retaining ring of the fitment helps to retain the fitment in position by abutting the lower aspects of locking ridge 72.

If desired, the spout 36 may be provided with an anti-drip lip. Also, it may be desirable to provide the spout with a V-shaped pouring angle for improved control of pouring of the product.

The drainback fitment 14 may be formed from a thermoplastic such as high density polyethylene. Or it may be made of a polyethylene which is a product of a 50:50 blend of a high density resin and a low density resin. The high density resin can be U.S.I. LS 506 or a similar resin. The low density resin can be U.S.I. LS 208 or the like. Instead of a mix of resins, a low density polyethylene such U.S.I. 241 or even a harder material such as polypropylene may be used to form the fitment. Other plastic resins having chemical and physical properties similar to the aforementioned resins can be used in fabricating the drainback fitment 14.

Preferably, the container of the invention provides the spout and drainback area in the form of the above described fitment, separate from the body of the bottle. In the described preferred embodiment, the fitment snaps into the container finish so that a friction fit is obtained between the outer wall of the fitment and a locking ridge on the inside of the container finish. A fitment may also be provided in other ways, eg it may be applied by spin welding, or by hot melt adhesive or by the EMABOND system. An internally threaded finish may be combined with an externally threaded closure.

The EMABOND system employs a thermoplastic gasket impregnated with metal particles. When the gasket is in position (between a sealing area ridge of the fitment and inside bottle neck ledge), a sealing unit with an electromagnetic force presses down on the fitment and heats up the metal particles, thereby melting the plastic gasket, and the compression welds the two components together with a leak-proof seal.

Although the fitment would normally be a separate piece, it may also be formed integral to the bottle. A threaded collar could then be spin welded onto the exterior of the bottle to mate with the threads of the closure.

It is also contemplated that some of the embodiments may be in the form of refill bottles which contain a plain screw cap and no spout but which are capable of receiving a transferable spout and self draining closure.

The closure 12 has a closed end 38 at its top which is merged at its circumference with a downwardly extending inner circumferential wall 46 having a surface onto which there are integrally molded gripping teeth 42 biased to present greater friction to the hand when the closure 12 is rotated counterclockwise to loosen it than when it is rotated clockwise for tightening. Alternatively, other gripping means, such as vertical ribbings may be employed.

The inner circumferential wall 46 is concentric with and spaced from an outer circumferential wall 40. Inner circumferential wall 46 extends downwardly beyond the length of the outer circumferential wall 40. The inner circumferential wall 46 and the undersurface of the closed end 38 form a cup for measuring the contents of the container 2 as it is poured from the bottle 6. A fill line can be molded into the inner circumference of the inner wall if desired. Also, if desired, internal, narrowly spaced vertical ribs may be disposed on the inside of the closure to highlight the fill line.

The outer circumferential wall 40 and inner circumferential wall 46 are connected by a web 48 so that a downwardly facing (when the closure 12 is fastened to the bottle 6) channel is defined between the inner circumferential wall 46 and the outer circumferential wall 40. The channel is optionally lined with a liner preferably made of a resilient, polymeric material. However, it is preferred that the channel be linerless. The channel in cooperation with the frustoconical wall portion 16 and optional liner serves as a trap for preventing residual contents of the container 2 from migrating to the junction of the closure 12 and neck 10 of the bottle 6. If desired the liner may be omitted.

Complimentary fastener means in the form of threads are provided on the closure 12 and neck 10 of the bottle 6 at their juncture. The closure 12 has internal threads 50 which mate with external threads 74 on the finish 68 of the bottle. As the closure 12 is threaded onto the neck 10 of the bottle 6, the liner, if present, engages the mouth 70 of the bottle 6 thereby sealing the bottle to prevent leakage of the contents from the container. When the liner is omitted, the top of the channel seals against the mouth 70 of the bottle. The presence of the fitment rim below the top of the finish permits the closure (or the liner of the closure) to form a seal at one point at the top of the finish. If the fitment rim extended over the top of the fitment there would be two areas for liquid product to escape through the seal, above and below the rim of the fitment.

The inside of the land of the bottle may be beveled to assist in sealing. The bevel imparts to the top of the mouth a sharp point from which the inner wall of the mouth slants inwardly. The outer wall of the mouth is disposed generally vertically. Whether the closure is on or off, the friction fit of fitment 14 against locking ridge 72 within the bottle finish 68 prevents escape of the product except through the spout, the drainage aperture or the product exit aperture. When the closure is screwed closed, product which has exited bottle 6 through the spout, drainage aperture or product exit aperture is contained within container 2 by the closure.

As is apparent from FIG. 2, except for the spout, fitment 14 is wholly contained within the bottle 6. The entire outer wall 16 is situated below the mouth 70 of this bottle.

Although the fitment herein has been described as having a single product exit aperture, a plurality of apertures may be utilized.

In addition to serving to permit use of the last portion of the product, the product drainage aperture also serves as a vent hole as well. As such, it permits air to enter the container as product leaves through the spout.

The product exit aperture may assume any shape and size suitable for permitting exit of at least a portion of the last fraction of product trapped between the outside of the fitment and the wall of the bottle, e.g. triangular, rectangular or square, or may take the form of a slit. Preferably, the exit aperture is of a size and shape suitable for venting, as well. The product exit aperture is located high enough in the fitment wall such that at least a portion of liquid trapped when the bottle is turned upside down can escape. The product exit aperture is described herein as being positioned approximately halfway down the wall of the fitment, although it may be located one quarter of the way down or three quarters of the way down or elsewhere, depending on the dimensions of the container.

While certain features such as the annular rim and the retaining ring have been illustrated and/or described as extending 360 degrees around the circumference of the fitment, it will be apparent that such will not always be necessary in order that their functions be fulfilled in accordance with the invention. For instance, the annular rim may be replaced by other stopping means and the retaining rim may be replaced by other retaining means. Stopping means refers to the annular rim and equivalent structures even in fitments and containers wherein the friction fit between the fitment wall 16 and the locking ridge 72 is sufficient to prevent the entire fitment from being pushed through and into the bottle.

The closure may be formed of a harder material than that used in the drainback fitment 14. In the preferred embodiment of the invention, the plastic material from which the closure 12 is molded is a homopolymer polypropylene such as that sold by Phillips Petroleum Company under the designation Phillips HLV 120-01 or may be polypropylene copolymer.

The bottle 6 also may be formed of a material that is harder than the material employed in the drainback fitment 14. Alternately, the fitment may be formed of a harder material, as where the fitment is fabricated from polypropylene. Materials from which the bottle may be fabricated include high density polyethylene. In accordance with certain embodiments of the invention, the bottle is made from multiple polymeric layers, which include an inner layer including metallocene polyethylene.

The inner layer should possess good stress crack resistance, as determined according to ASTM D-1693-95. That is, the layer preferably has at least 75 hours, and more preferably at least 100 hours, most preferably at least 300 hours stress crack resistance under that test. In general, good stress crack resistance is promoted by the selection of resins having an appropriate distribution of chain lengths, especially distributions favoring long chain lengths. Stress crack resistance is important to the ability of the package to contain effectively its contents for prolonged periods of time on the shelf or in the consumer's cupboard. Polymer layers which have a lower MI (lower melt index) promote stress crack resistance, since they tend to have longer molecular chain lengths, and impact resistance, as well.

Preferably, the container also possesses a good drop strength resistance so that a water filled bottle will survive at least one 3-foot drop onto its base. The drop strength can be important to assure that the container can withstand the travails of packing, shipment, and use and storage by the consumer.

ASTM D1693-95 ESCR test results are believed to be good indications of whether a resin has good stress crack resistance. Resins which are understood to have good ASTM D1693-95 ESCR test results and which are therefore good candidates for the high ESCR layers of the invention include:

"Exact 3035" (MPE) (0.900 density, melt index of 3.5 dg/min (0.35))—from Exxon "Engage" available from Dow Chemical.

The inner layer may be a blend such as metallocene polyethylene and high density polyethylene (HDPE) such as one at about 25%75% by wt %.

Very low density polyethylene polymers with which the metallocene polyethylene polymers may be blended include:

Paxon AC 45-004 (0.945 density); Chevron 9503 (0.946 density); Chevron 9346 (0.9455 density) (pipe resin); Phillips D252 (Marlex) LLDPE (25% LLDPE/75% HDPE) (density 0.923; melt index 0.25)—Resin is called "low density, linear polyethylene on data sheet.

The high stress crack resistant inner layer may be pigmented or non-pigmented.

It is further preferred that the density of the outer layer be higher, eg from 0.948 to 0.964. The optional middle layer may also be high density. The selection of a resin, such as a high density polyethylene having a density in the higher ranges (eg, 0.945 to 0.964 and above) will assist in making the container more resistant to top load pressure. Examples of materials which may be used include Paxon AU55-003, a medium molecular weight distribution high density polyethylene copolymer available from Paxon Polymer Company of Baton Rouge, La., and Paxon AC45-004, a high density polyethylene copolymer available from Paxon Polymer Company. Either of the above may advantageously be used in conjunction with a percentage, say 25% of a recycled resin, i.e., a post-consumer recycled resin (PCR) such as a high density polyethylene bottle scrap.

Preferably, the container comprises panels having a multilayer structure including i) an outer higher density material, ii) an optional middle layer comprising a minimum of 25% recycled resin, and iii) an inner, lower density, lower MI layer including metallocene polyethylene. It is especially preferred that the features of the individual or combined embodiments of the invention be present in a bottle fabricated from a multilayer structure including i) a high stress crack resistant virgin inner layer including metallocene polyethylene, ii) an optional second layer comprising a minimum of 25% recycled resin, and iii) a virgin resin outer layer. In accordance with another a still further aspect of the invention, the bottle is made from i) an outer higher density material, ii) an optional middle layer comprising a minimum of 25% recycled resin, and iii) an inner, lower density, lower MI layer comprising metallocene polyethylene. Recycled resin is preferably HDPE from used milk or water bottles and possibly used detergent bottles of about the same color.

Other advantageous combinations of multiple layers are possible, I) high ESCR inner and outer layers, the inner layer including metallocene polyethylene; II.) high ESCR inner layer and outer layers and a foamed inner layer, the inner layer including metallocene polyethylene and, III) high ESCR inner and outer layers/rigid resin in outer and/or middle layer, the inner layer including metallocene polyethylene. Instead of LLDPE, LDLPE or a blend of LDLPE and HDPE may be used.

Ranges of thicknesses preferred in a multilayer material would be 10–20% outer, 20–80% middle and 10–20% inner. A useful arrangement (percentage thickness) of layers is expected to be 10% outer layer, 80% middle layer and 10% inner layer. Thickness may be measured in millimeters or mils (thousandths of an inch).

Additional preferred resins for the outer layer include:

Chevron polyethylene 9402 (20%);

Chevron polyethylene 9503 (20%):

Additional preferred resins for the middle layer (70%): Chevron virgin 9402 PCR polyethylene homopolymer (employs recyled PE)

Additional preferred resins for the inner layer: Chevron 9301 polyethylene (10%). Chevron virgin 9402 PCR polyethylene homopolymer (employs recyled PE)

While trilayer structures (5–30% outer/60–90% middle/5–30% inner layers, particularly 10–20% outer/70–80% middle/10–20% inner layers) will generally be preferred, bilayer or monolayer structures may also be used. While it will generally be preferred that inner and outer layers be virgin (ie not recycled, resin), the inner layer may include some recycled resin. Where the inner layer includes recycled resin, one candidate will be blends containing LLDPE from recycled pallet stretch film. Other good candidates for the inner layer include LLDPE and LLDPE/HDPE blends, metallocene polyethylene (MPE) (e.g., Exxon's Exact) and MPE/HDPE blends. It will generally be preferred that middle layer include at least 25% PCR. A foamed HDPE middle layer may also be used.

In accordance with the invention, the finished end or body of the bottle is preferably lightweighted. That is, the finished end or body is made of a material which is lighter in weight than standard materials from which heavy duty liquid detergent bottles are made. This permits less material to be used and results in less material to be disposed of after the contents of the bottle have been consumed.

Despite the lightweight of the bottle, body and finish, especially in combination with other features described and claimed herein, the bottle can enjoy good stress-crack resistance and preferably also, dent resistance and drop strength and compressive strength. Numerous features are believed to contribute to the structural strength of the body despite its lightweight.

On the front and sides of the bottle, finish 10 of the body of the bottle leads to downwardly sloping shoulder 11. To the rear of the bottle, integral handle 8 extends backwardly and then downwardly. Wall 9 extends almost vertically from the finish behind and to the sides of the handle. Generally horizontal shoulder 13 is formed as a continuation of wall 9 in front of, and on either side of, the handle.

Extending downwardly from shoulder 11 are medial front panel 230, first and second lateral front panels 232 and 234, and first and second side panels 236 and 238. Portions of side panels 236 and 238 also extend from wall 9 and from horizontal shoulder 13. Extending downwardly from shoulder 13 are first and second lateral rear panels 240 and 242. Medial rear panel 244 also extends downwardly from shoulder 13, and in addition, from the bottom of handle 8.

Figure 6:
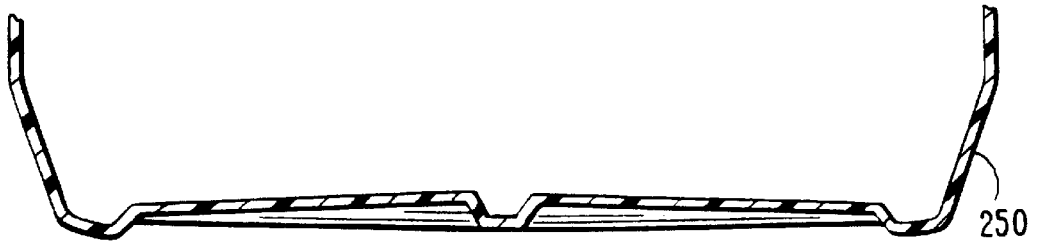
FIG. 6 is a section along the lines 6—6 of FIG. 5.
Figure 7:
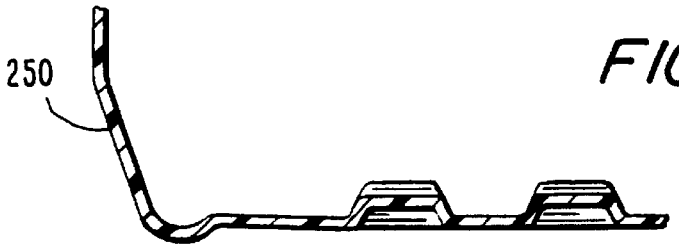
FIG. 7 is a section along the lines 7—7 of FIG. 5.

Below panels 230, 232, 234, 236, 238, 240, 242 and 244 is an optional bottom wall 250, which slants inwardly from each of the panels. Bottom wall 250 leads to base 260 (See, especially FIGS. 5–7), which comprises a peripheral ring 262 and an interior recessed area 264 within the ring. Interior recessed area 264 is divided in half by external rib 270 which projects outwardly from the surface of area 264. Within recessed area 264 is a waffle pattern, which may be in the form of a series of debossments 214 formed in the bottom panel 216 of the bottle. Alternatively, if desired, a series of embossments rather than debossments with respect to the bottom panel may be used. The embossments or debossments may be in the form of rectangles as shown in FIG. 5 or may assume another shape.

The described patterns of embossments or debossments provide enhanced structural strength, particularly for impact resistance.

Figure 4:
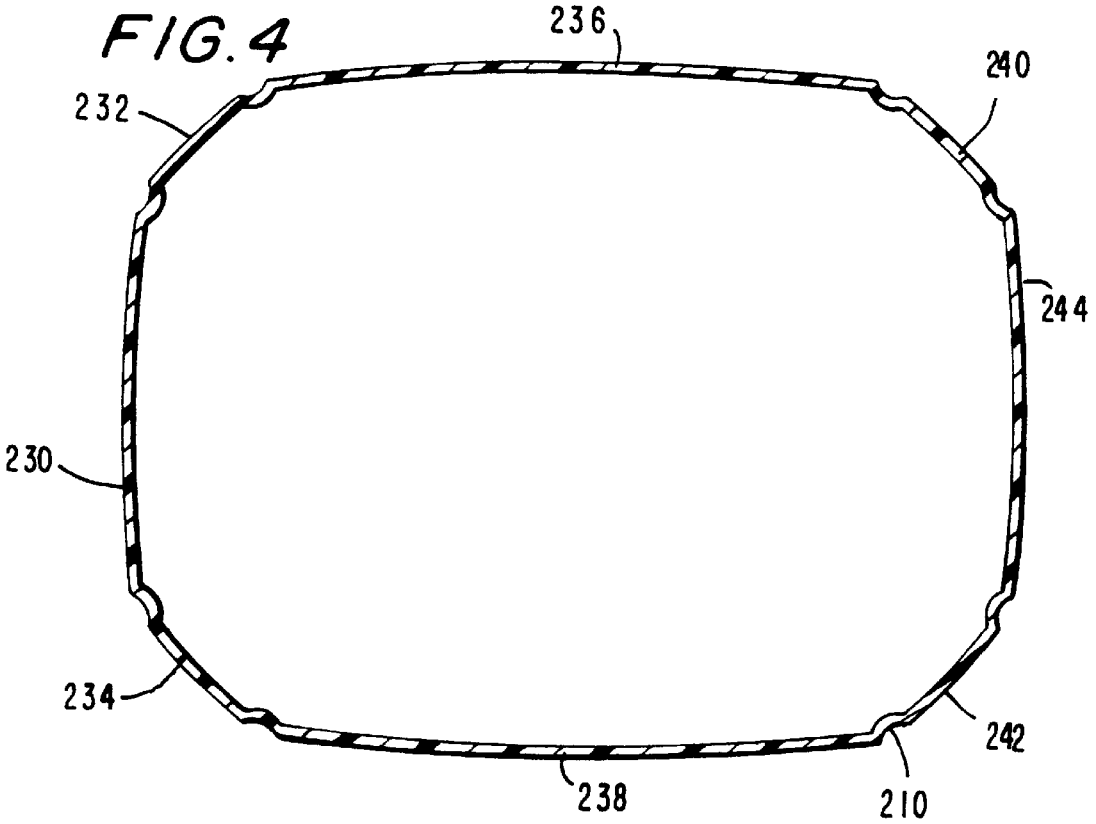
FIG. 4 is a section along the lines 4—4 of FIG. 2.
Figure 5:
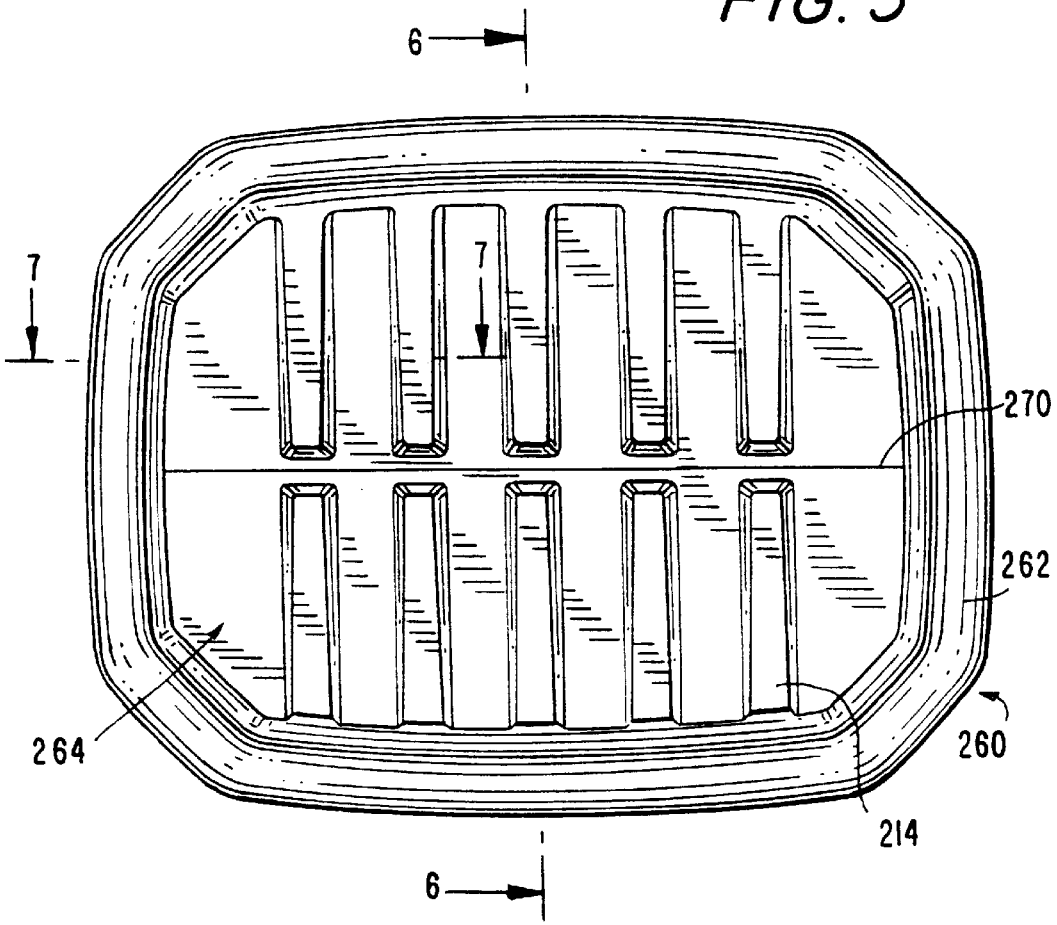
FIG. 5 is a bottom plan view along the lines 5—5 of FIG. 2.

As best seen from FIGS. 1, 4 and 5, the body of the bottle has an octagonal cross section formed by panels 230, 232, 234, 236, 238, 240, 242 and 244. In the embodiment of FIGS. 2, et seq., at each of the corners formed by intersection of the panels with each other, a vertically extending groove 210 is formed in the outer wall of the bottle. Alternatively, a rib (extending outwardly with respect to the outer surface of the container as opposed to the inwardly extending groove) may be employed in place of the groove. The grooves or ribs disposed at the panel intersections, in conjunction with the generally octagonal cross section and the "highlight" groove(s) described below, are believed to increase the rupture resistance of the bottle. However, it has been discovered that the grooves or ribs may be omitted and a suitable lightweighted bottle still obtained. Thus, in FIG. 1, no ribs or grooves are present at the corners. The octagonal shape itself is believed to contribute importantly to compressive or top load strength.

In addition to optional vertical grooves 210 at the bottle corners, optional horizontal grooves 212 and other optional vertical grooves 211 (not disposed at panel intersections), which connect with some of the horizontal grooves may contribute to the integrity of the bottle, particularly impact resistance. As seen in part in FIG. 1, these grooves which also "highlight" certain features of the bottle, extend horizontally from the base of the handle, across the top of the rear panel, a corner panel, a portion of the side panel 238, and then upward along the top of the side panel, along the top of another corner panel, the front panel, a portion of the second side panel, then downwardly along the top of the second side panel, along the top of the next corner panel and then back along the top of the rear panel to return to the base of the handle. Again, ribs may be used instead of grooves here, as well. If desired, the bottle may be stippled, particularly above grooves 212 and 211, as illustrated in British registered design 2033440.

Figure 8:
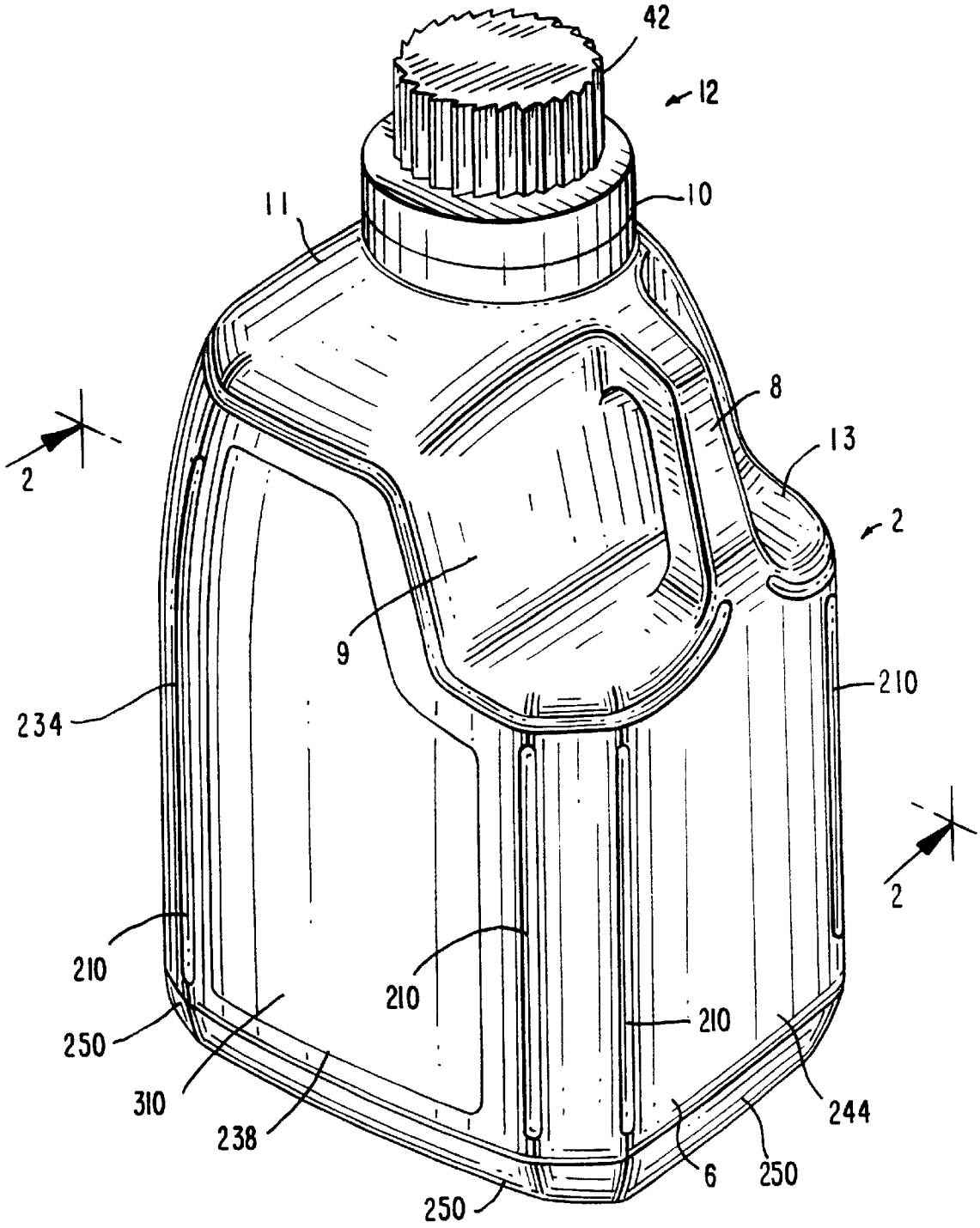
FIG. 8 is a perspective view similar to FIG. 1 of a container of the invention having an in-mold label and corner grooves.

Another noteworthy advantage comes from the combination of the lightweight bottles and plastic in-mold labels (IML). In-mold label 310 on bottle is shown in FIG. 8. By "in-mold label" it is meant that the label is placed in the mold halves before the mold halves are clamped around the parison and the bottle is blown against the mold walls. This takes the place of affixing the label to the bottle after molding. Use of inmold labels is believed to provide an advantage in laboratory drop and ESCR (stress crack resistance) tests.

Embodiments may include a conventional adhesive applied label or, indeed, no label.

The structure of the bottle of the invention is expected to permit use of lighter weight materials than would otherwise be possible. For instance, it is expected that an empty 128 fluid oz heavy duty liquid container can be produced having approximately ½ the normal weight for such containers (80 grams vs. the more usual 160 grams). Bottles according to the invention can be expected to have a gram weight reduction of from 25 to 33% as compared to bottles typically used for heavy duty liquid detergent products.

The use of a neck or finish which is displaced from the center is believed to facilitate pouring of product from the container. To determine whether a neck finish is off-center for the purposes of the invention, one measures the distance from one side to the other of the bottle's length, measured at the point of maximum length, i.e., the maximum horizontal dimension when the container is standing on its base. Then one determines the center point of that distance from one side to the other. The next step is to ascertain where the center point of the container finish, ie the center of the bottle mouth, falls along the line drawn from one side of the container to the other at its longest length. The percentage displacement is calculated by subracting the distance in position between the center point of the finish and the center of the container length at its widest point and dividing that figure by the length of the bottle at its widest point.

An example of the percentage displacement calculation is as follows. If the container has its maximum length at the bottom, and the length of the bottom is 16 cm, and a vertical line drawn through the center of the finish intersects the length line at 10.6 cm, the calculation is as follows: (10.6 minus 8 (the midpoint of the length)), divided by 16. The result is 16.25%. For the purposes of the invention, a neck finish is considered off center if the displacement percentage is greater than 3%. Preferred displacments are from 3% through 20%. Especially preferred is if the percentage is from 5%–20%.

Use of a large diameter neck or finish, eg on the order of from 50 to 88 mm, minimizes "glugging" of product emerging from the container and distributes polymer in such a way as to increase the topload strength of the container.

Advantageously, the bottle of the invention can be made on a wheel machine, i.e., a high speed production blow molding apparatus, or a Uniloy brand or other shuttle machine. A "wheel" machine rotates and clamps around a continuously extruded parison. Bottles are ejected after forming.

Bottles according to the invention which were 20% lighter than current heavy duty liquid bottles sold by a major detergent manufacturer, were found to be as sturdy, durable and vigorous as the full weight, current bottles.

It will be apparent that the pouring fitment and container of the invention may be used for liquid laundry and other detergents, fabric softeners and many other types of liquid household and other products.

As used herein, "handle" refers to a structure for holding the bottle where there is a "hole" through which the human hand can extend. A gripping feature is a pair of indentations facilitating the holding of the bottle by a human hand, but which does not include a "hole."

Examples of multi layer resins which may be used to make the bottles of the invention, are as follows:

| Variable | Inside Layer | Middle Layer | Outside Layer |
|---|---|---|---|
| 1 | metallocene PE layer | 9503-PCR/Regrind | 9503/3% Colorant |
| 3 | metallocene PE layer | LX4570/PCR/Regrind | LX4570/3% Colarant |
| 6 | metallocene PE layer | 9602/PCR/Regrind | 9602/3% Colorant |

Note:
9503 = 0.948 density
LX4570 = 0.955 density
LX4225 = 0.950 density
9602 = 0.964 density
9346T = 0.945 density It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

What is claimed is:

1. A bottle comprising a downwardly extending body fabricated from at least two layers, including an internal layer wherein the internal layer is a very low density metallocene polymer and wherein said bottle further comprises a finish having an annular mouth, said body extending axially downwardly along a vertical axis from said finish to a base; said body including a shoulder extending outwardly and downwardly below said finish; and a pour spout associated with said finish extending upwardly from a bottom wall having a product drainage aperture, said bottle, exclusive of closure and fitment, weighing less than 1.2 grams per fluid oz. of capacity.

2. The bottle according to claim 1 wherein said body includes 8 axially extending side panels extending axially downwardly below said shoulder.

3. The bottle of claim 1 wherein said container body inner layer has a stress crack resistance of at least 100 hours as measured using ASTM D1693-95.

4. The bottle of claim 1 having a compressive strength of at least 70 pounds.

5. The bottle according to claim 1 further comprising an integral handle or gripping surface.

6. The bottle according to claim 1 wherein the body of the bottle is made from a multilayer structure comprising at least three layers.

7. The bottle according to claim 1 weighing between 1 gram and 0.5 grams per fluid oz.

8. The bottle according to claim 1 wherein the internal layer is non-pigmented.

9. The bottle according to claim 1 wherein the internal layer constitutes from 10 to 20% of the thickness of the bottle.

10. The bottle according to claim 1 further comprising:

said body including from 6–10 axially extending side panels extending axially downwardly below said shoulder;

a plurality of axially extending intersections being formed at intersections of at least some of said side panels;

at least 50% of said axially extending intersections comprising a groove or rib extending axially at least 60% of the distance along said intersection between said panels:

said neck having a diameter within the range of 50 to 88 mm.

11. The bottle according to claim 10 further comprising an integral handle or gripping surface.

12. The bottle according to claim 1 further comprising:

said body including from 6–10 axially extending side panels extending axially downwardly below said shoulder;

a plurality of axially extending intersections being formed at intersections of at least some of said side panels;

at least 50% of said axially extending intersections comprising a groove or rib extending axially at least 60% of the distance along said intersection between said panels: and an in-mold label.

13. The bottle according to claim 12 further comprising an integral handle or gripping surface.

14. The bottle according to claim 1 further comprising:

said body including from 6–10 axially extending side panels extending axially downwardly below said shoulder;

a plurality of axially extending intersections being formed at intersections of at least some of said side panels;

at least 50% of said axially extending intersections comprising a groove or rib extending axially at least 60% of the distance along said intersection between said panels: and an off centered neck.

15. The bottle according to claim 14 further comprising an integral handle or gripping surface.

16. The bottle according to claim 1 further comprising:

said body including from 6–10 axially extending side panels extending axially downwardly below said shoulder;

a plurality of axially extending intersections being formed at intersections of at least some of said side panels;

at least 50% of said axially extending intersections comprising a groove or rib extending axially at least 60% of the distance along said intersection between said panels:

said multilayer body structure including in addition to said inner layer, a middle layer including a minimum of 25% recycled resin, and a virgin resin outer layer.

17. The bottle according to claim 16 further comprising an integral handle or gripping surface.

18. The bottle of claim 1 further comprising a) a finish having an annular mouth;

b) said body extending axially downwardly along a vertical axis from said finish to a base;

c) said body including a shoulder extending outwardly and downwardly below said finish;

d) said body including from 6–10 axially extending side panels extending axially downwardly below said shoulder; and e) a plurality of axially extending intersections being formed at intersections of at least some of said side panels;

f) at least 50% of said axially extending intersections comprising a groove or rib extending axially at least 60% of the distance along said intersection between said panels;

g) said body multilayer structure including in addition to said inner layer, an outer higher density layer and a middle layer including a minimum of 25% recycled resin.

19. The bottle according to claim 18 further comprising an integral handle or gripping surface.

20. The bottle according to claim 1 in combination with liquid detergent contained within said bottle.

21. The bottle according to claim 20 wherein the liquid detergent is a heavy duty liquid detergent.

22. The bottle according to claim 1 further comprising:

said body including from 6–10 axially extending side panels extending axially downwardly below said shoulder;

a plurality of axially extending intersections being formed at intersections of at least some of said side panels;

at least 50% of said axially extending intersections comprising a groove or rib extending axially at least 60% of the distance along said intersection between said panels; and an optional tapered base panel extending from said side panels to said bottle base.

23. The bottle according to claim 22 wherein said pour spout and drainage aperture are provided by a fitment associated with said finish and including i) a generally annular side wall and ii) a bottom wall extending inwardly from the bottom of said side wall and including said product drainage aperture and wherein said pour spout extends upwardly from said bottom wall generally concentrically with said side wall.

24. The bottle of claim 22 wherein from 65–90% of the intersections including said groove or rib extending axially at least 60% of the distance along said intersections.

25. The bottle according to claim 22 wherein from 65–90% of said intersections include said groove or rib extending axially from 65–90% of the distance along said intersections.

26. The bottle according to claim 22 wherein said finish comprises internal threads which mate with external threads on said bottle finish.

27. The bottle according to claim 22 wherein the fitment has internal threads and is secured to the container by i) spin welding, ii) hot melt, or iii) electromagnetic welding using a metal-impregnated thermoplastic gasket.

28. The bottle according to claim 22 capable of receiving a transferable spout and self draining closure.

29. The bottle according to claim 22 having an integral fitment and a threaded collar spin welded to the exterior of the bottle to mate with the threads of the closure.

30. The bottle of claim 22 further comprising a closure having an end wall, an inner circumferential wall depending from said end wall, an outer circumferential wall concentric with and spaced from said inner circumferential wall, a web parallel to and spaced from said end wall and connecting said inner and outer circumferential walls, threads formed on the inside of said outer circumferential wall mating with outer threads on the finish.

31. The bottle of claim 30 wherein said container body has a drop strength such that a water filled bottle at 73° F. will survive one 3 foot drop onto the base without rupturing.

32. The bottle according to claim 22 wherein:

said finish comprises a locking ridge extending inwardly from said mouth;

said fitment is friction fit within said finish; and said annular side wall frictionally abuts the locking ridge of said finish.

33. The bottle of claim 32 wherein said pour spout includes a longitudinal slot extending downwardly from the top rear of the spout in alignment with the drainage aperture and is separated from said aperture by a spout rear wall.

34. The bottle of claim 33 wherein said fitment further includes a generally annular rim extending radially outwardly from the top of said side wall.

35. The bottle of claim 34 wherein said fitment further comprises a product exit aperture in its side wall.

* * * * *